US007837546B2

(12) United States Patent
Bennett et al.

(10) Patent No.: US 7,837,546 B2
(45) Date of Patent: Nov. 23, 2010

(54) GAMING MACHINE WITH WIN CHANGE SYMBOL

(75) Inventors: Nicholas Luke Bennett, Manly Vale (AU); Natalie Bryant, Cherrybrook (AU)

(73) Assignee: Aristocrat Technologies, Inc. (AU)

( * ) Notice: Subject to any disclaimer, the term of this patent is extended or adjusted under 35 U.S.C. 154(b) by 1329 days.

(21) Appl. No.: 10/296,077

(22) PCT Filed: May 14, 2001

(86) PCT No.: PCT/AU01/00550

§ 371 (c)(1),
(2), (4) Date: Nov. 19, 2002

(87) PCT Pub. No.: WO01/89646

PCT Pub. Date: Nov. 29, 2001

(65) Prior Publication Data

US 2003/0186737 A1 Oct. 2, 2003

(30) Foreign Application Priority Data

May 22, 2000 (AU) ..... PQ 7664

(51) Int. Cl.
*A63F 9/24* (2006.01)

(52) U.S. Cl. ..... 463/16; 463/20

(58) Field of Classification Search ..... 463/16, 463/20

See application file for complete search history.

(56) References Cited

U.S. PATENT DOCUMENTS

| | | | | |
|---|---|---|---|---|
| 6,386,973 | B1 * | 5/2002 | Yoseloff | 463/13 |
| 6,517,432 | B1 * | 2/2003 | Jaffe | 463/16 |
| 6,554,704 | B2 * | 4/2003 | Nicastro et al. | 463/20 |
| 6,663,487 | B1 * | 12/2003 | Ladner | 463/13 |

FOREIGN PATENT DOCUMENTS

| | | |
|---|---|---|
| AU | 46824/97 | 6/1998 |
| AU | 17318/99 | 9/1999 |
| EP | 238289 | 9/1987 |
| EP | 420586 | 4/1991 |
| EP | 926645 | 6/1999 |

OTHER PUBLICATIONS

International Search Report issued Jun. 14, 2001.

* cited by examiner

*Primary Examiner*—Peter DungBa Vo
*Assistant Examiner*—Omkar Deodhar
(74) *Attorney, Agent, or Firm*—McAndrews, Held & Malloy, Ltd.

(57) ABSTRACT

A gaming machine (10) has a display (14) and a game controller arranged to control images displayed on the display (14). The game controller is arranged to play a game (16) wherein at least one random event is caused to be displayed on the display (14). If a predefined winning event occurs, the machine (10) awards a prize. When a special symbol is carried by a symbol-carrying element into a display position on the display (14), the special symbol does at least one of altering the prize awarded for a winning result and altering a defined set of winning combinations.

5 Claims, 9 Drawing Sheets

| | | | | |
|---|---|---|---|---|
| 9 | J | 9 | 10 | Q |
| J | 9 | J | J | K |
| Q | Q | Q | Q | J |

GAMING MACHINE WITH WIN CHANGE SYMBOL

FIELD OF THE INVENTION

This invention relates to a gaming machine. More particularly, the invention relates to a gaming machine and to an improvement to a game played on such a gaming machine.

BACKGROUND TO THE INVENTION

Players who regularly play gaming machines quickly tire of particular games and therefore it is necessary for manufacturers of these machines to develop innovative game features which add interest to the games. In so doing, it is hoped to keep players amused and therefore willing to continue playing the game as well as to attract new players.

Also, with the growth that has occurred in the gaming machine market, there is intense competition between manufacturers to supply various existing and new venues. When selecting a supplier of gaming machines, the operator of a venue will often pay close attention to the popularity of various games with their patrons. Therefore, gaming machine manufacturers are keen to devise games which are popular with the players as a mechanism for improving sales, retaining customers and attracting new customers.

SUMMARY OF THE INVENTION

According to a first aspect of the invention, there is provided a gaming machine having a display means and a game control means arranged to control images displayed on the display means, the game control means being arranged to play a game wherein at least one random event is caused to be displayed on the display means and, if a predefined winning event occurs, the machine awards a prize, the gaming machine being characterized in that the game is a spinning reel game and, when a special symbol, carried on a reel is displayed on the display means, the special symbol alters a defined set of winning combinations applicable to that game.

The special symbol may determine which combinations of symbols are to be regarded as winning combinations.

The special symbol may be carried on one of the conventional reels of the game in which case the special symbol may substitute for a standard symbol in any winning combination in which the special symbol appears. Instead, the special symbol may appear on a dedicated, separate reel.

According to a second aspect of the invention, there is provided a gaming machine having a display means and a game control means arranged to control images displayed on the display means, the game control means being arranged to play a game wherein at least one random event is caused to be displayed on the display means and, if a predefined winning event occurs, the machine awards a prize, the gaming machine being characterized in that the game is a spinning reel game which includes a standard paytable and at least one further paytable and in that, when a special symbol is carried into a display position by a reel of the game, the special symbol causes one of said further paytables applicable to the game to be used to calculate the prize awarded for a winning combination of symbols.

Prizes for winning combinations of symbols in the at least one further paytable, of which there may be at least two, may vary in a non-uniform manner in comparison with corresponding prizes in the standard paytable.

The further paytables may award prizes that are higher than the corresponding prize in the standard paytable for that particular winning combination of symbols.

In accordance with this aspect also, the special symbol may be carried on one of the conventional reels of the game in which case the special symbol may substitute for a standard symbol in any winning combination in which the special symbol appears. Instead, the special symbol may appear on a dedicated, separate reel.

BRIEF DESCRIPTION OF THE DRAWINGS

The invention is now described by way of example with reference to the accompanying diagrammatic drawings in which:—

DETAILED DESCRIPTION OF THE DRAWINGS

Figure 1:
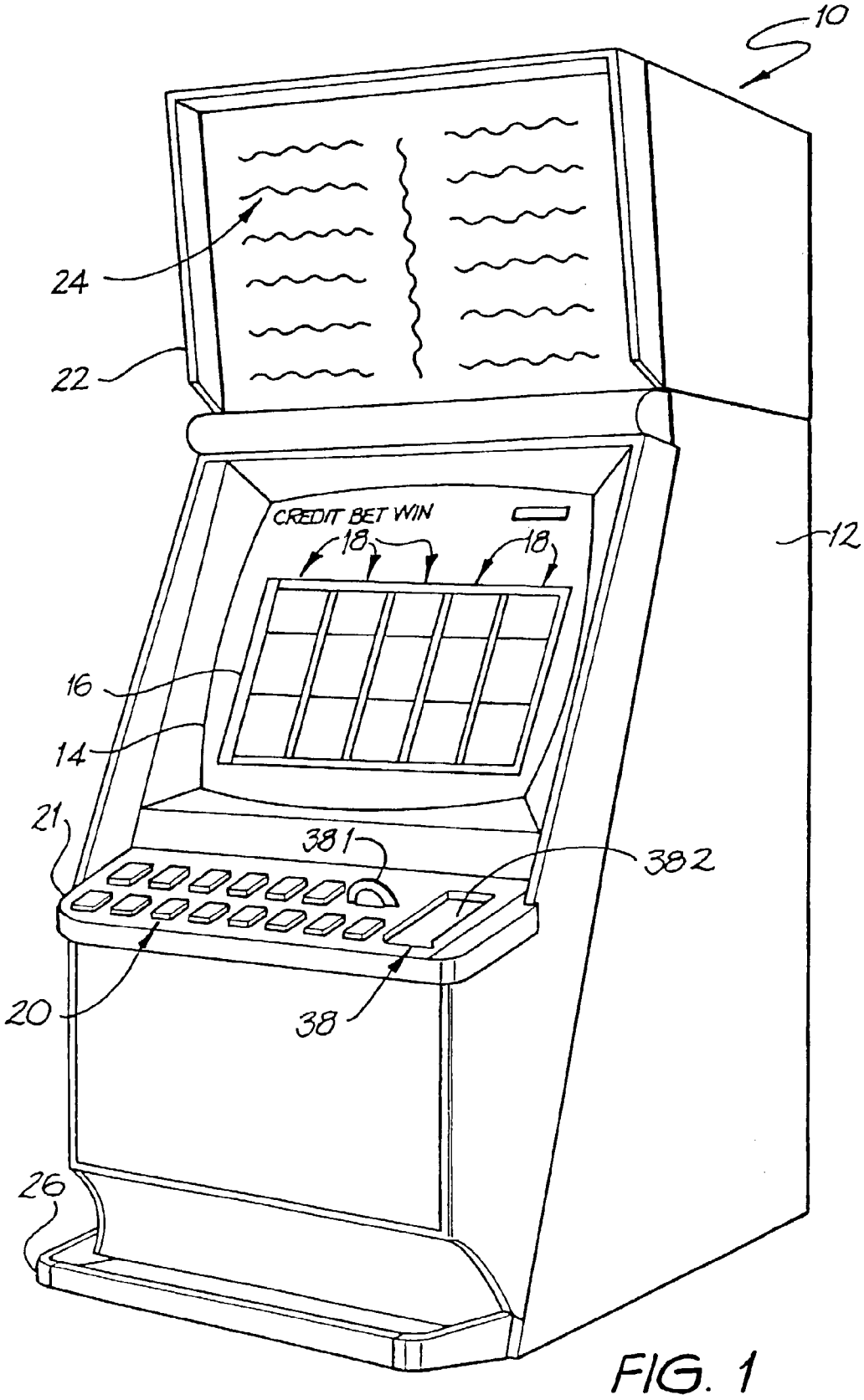
FIG. 1 shows a three dimensional view of a gaming machine, in accordance with the invention.

In FIG. 1, reference numeral 10 generally designates a gaming machine, including a game, in accordance with the invention. The machine 10 includes a console 12 having a video display unit 14 on which a game 16 is played, in use. The preferred form of the game 16 is a spinning reel game which simulates the rotation of a number of spinning reels 18. It will, however, be appreciated that the invention is equally applicable to other types of games such as card games or ball games such as Keno, or the like. A midtrim 20 of the machine 10 houses a bank 21 of buttons for enabling a player to play the game 16. The midtrim 20 also houses a credit input mechanism 38 including a coin input chute 38.1 and a bill collector 38.2.

The machine 10 includes a top box 22 on which artwork 24 is carried. The artwork 24 includes paytables, details of bonus awards, etc.

A coin tray 26 is mounted beneath the console 12 for cash payouts from the machine 10.

Figure 2:
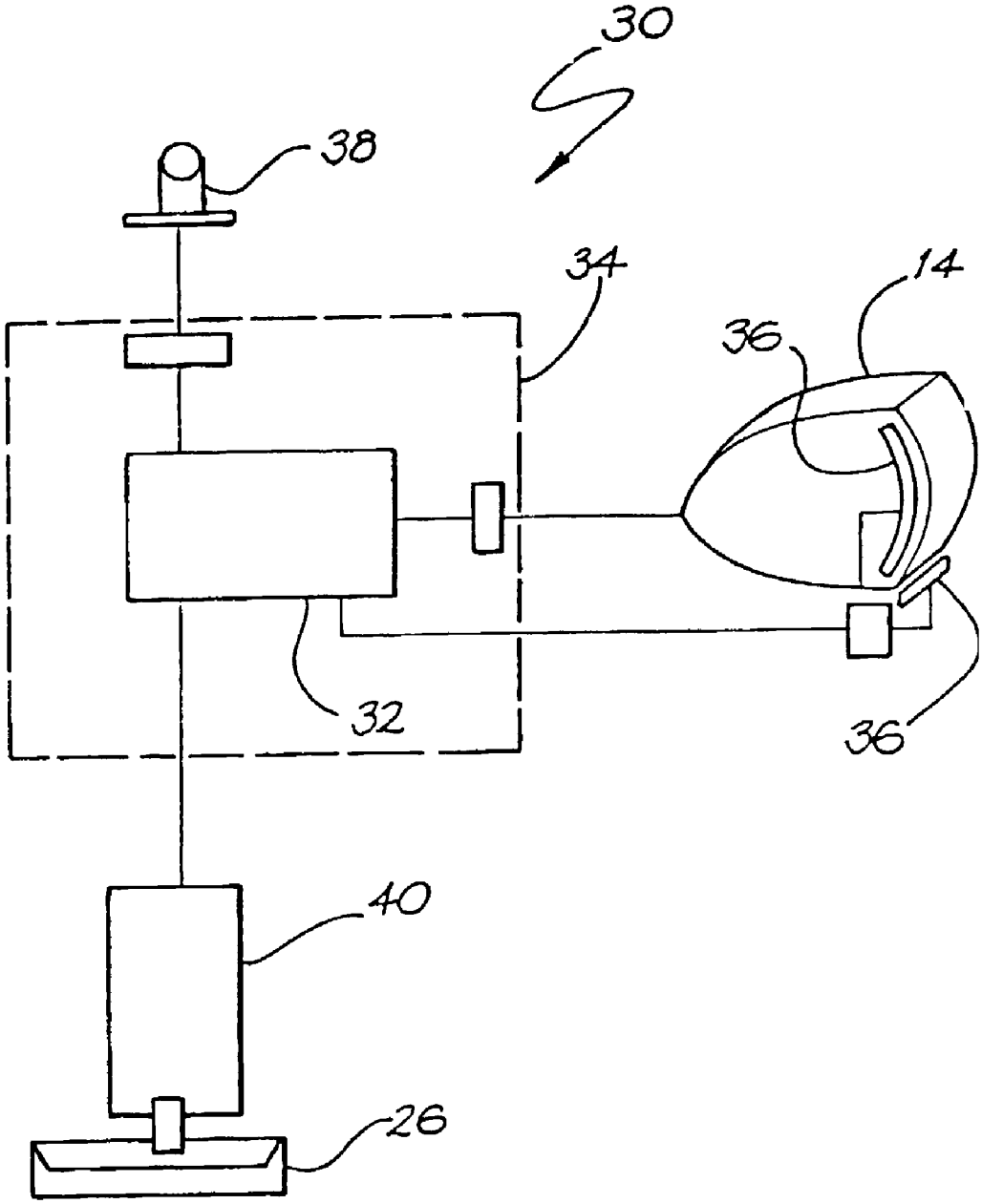
FIG. 2 shows a block diagram of a control circuit of the gaming machine.

Referring now to FIG. 2 of the drawings, a control means or control circuit 30 is illustrated. A program which implements the game and user interface is run on a processor 32 of the control circuit 30. The processor 32 forms part of a controller 34 which drives the screen of the video display unit 14 and which receives input signals from sensors 36. The sensors 36 include sensors associated with the bank 21 of buttons and touch sensors mounted in the screen. The controller 34 also receives input pulses from the mechanism 38 indicating that a player has provided sufficient credit to commence playing. The mechanism 38 may, instead of the coin input chute 38.1 or the bill collector 38.2, or in addition thereto, be a credit card reader (not shown) or any other type of validation device.

Finally, the controller 36 drives a payout mechanism 40 which, for example, may be a coin hopper for feeding coins to the coin tray 30 to make a pay out to a player when the player wishes to redeem his or her credit.

The invention relates to the use of a special symbol in the game where the special symbol performs a particular function. Thus, each symbol of the relevant type performs that function when it appears on the screen. Hence, in the case of a spinning reel game, the special symbols will be carried on the reel strips to be displayed at random intervals.

Figure 3:
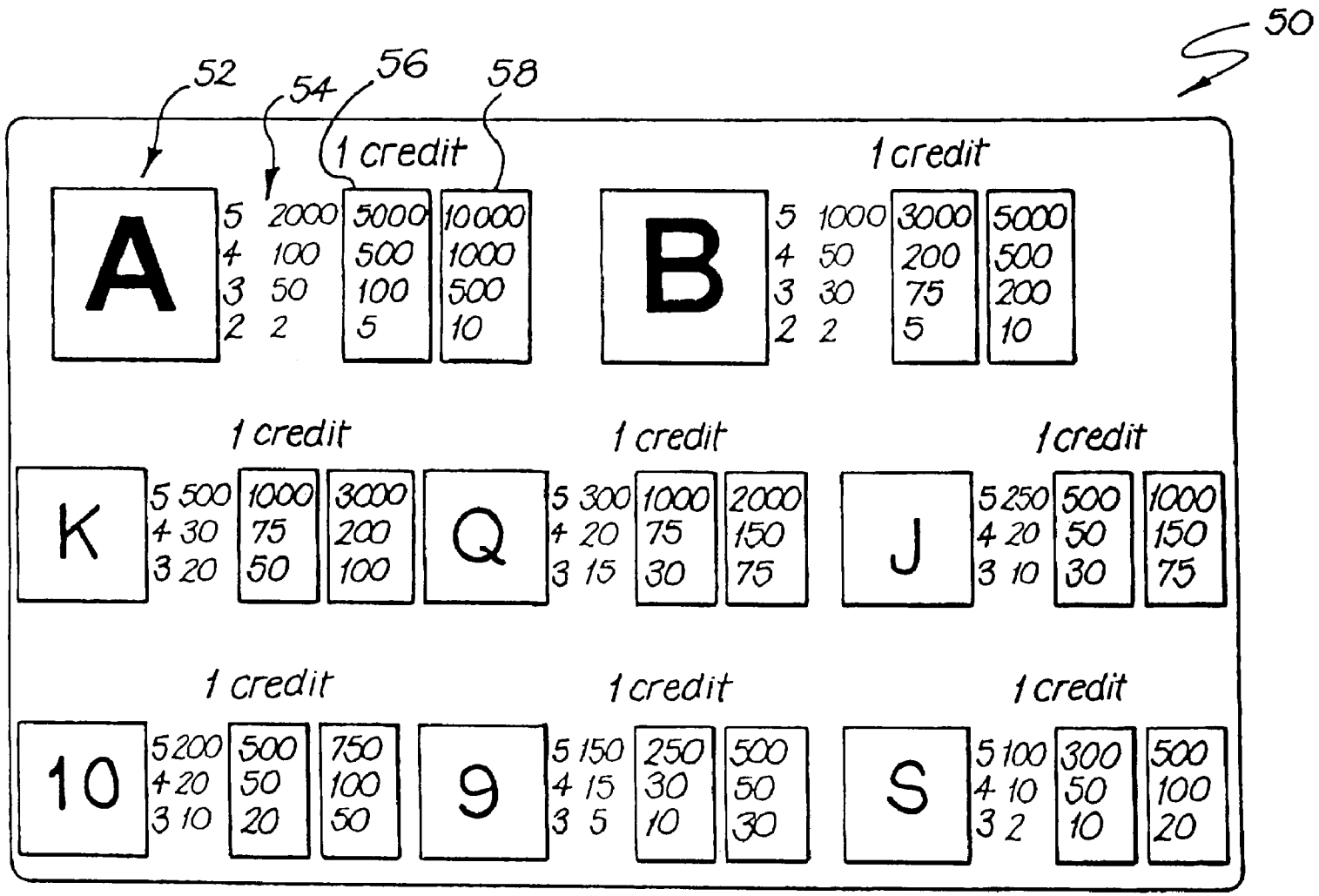
FIG. 3 shows a paytable for a game played on the machine of FIG. 1.

Referring initially to FIG. 3 of the drawings, a paytable is illustrated and is designated generally by the reference numeral 50. It is to be noted that, in respect of each of the standard symbols 52 demarcated on the paytable 50, each symbol 52 has three paytables 54, 56 and 58 associated with it.

Figure 4A:
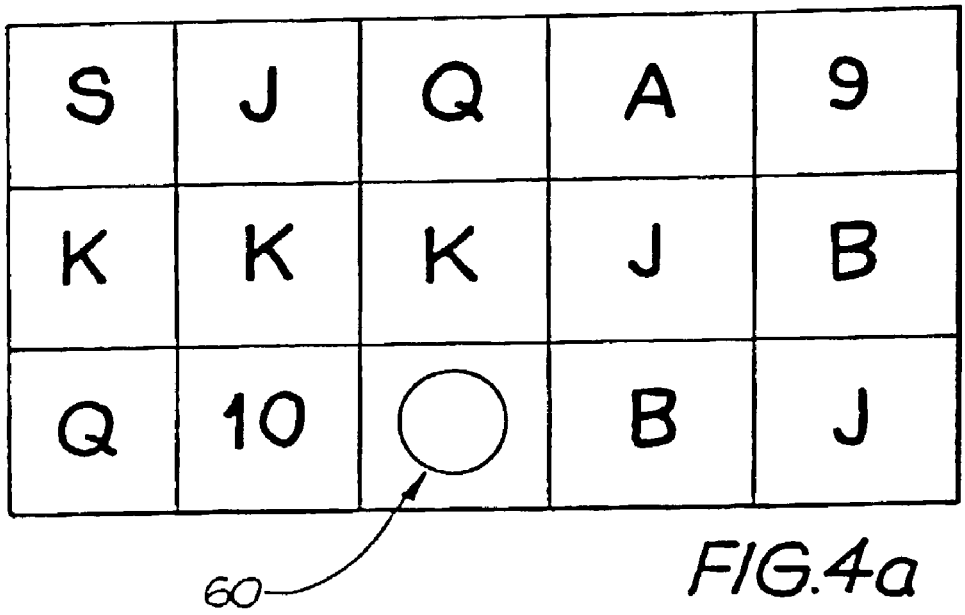
FIGS. 4*a* and 4*b* show screen displays of a first embodiment of the game played on the gaming machine of FIG. 1.
Figure 4B:
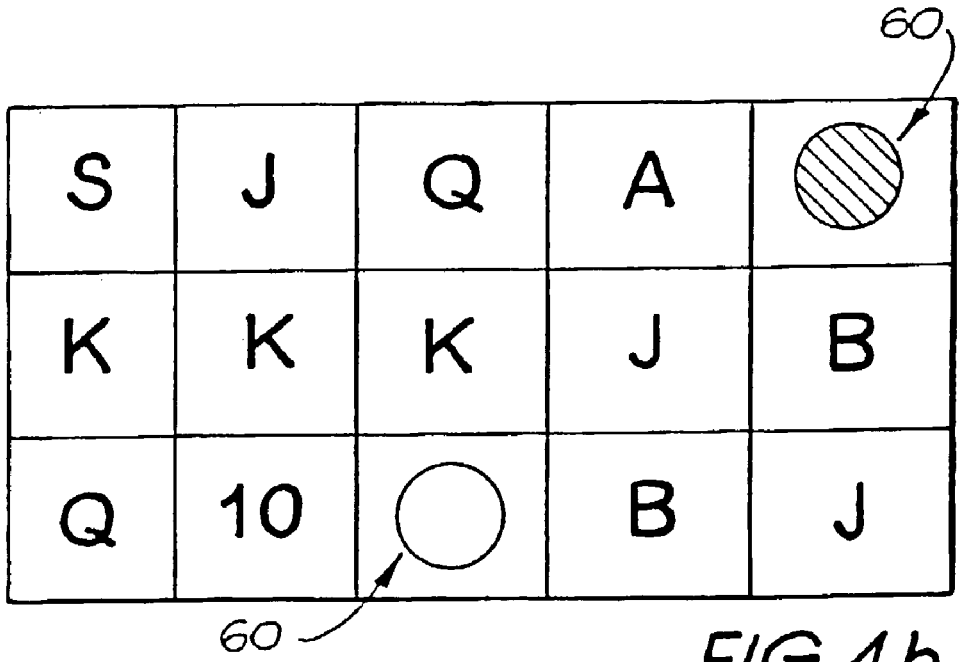

In the embodiment of the invention illustrated in FIGS. 4*a* to 4*c* of the drawings, a special symbol 60 is carried on at least one of the reels 18 of the game 16. In this regard, it is to be noted that the special symbol 60 could, if desired, be carried on a dedicated sixth reel (in respect of a five reel machine) rather than on one of the standard reels 18. The special symbol 60 in accordance with this embodiment of the invention determines the manner in which a current win is paid if a winning result occurs when the reels 18 are spun. Where the special symbol 60 is carried on the standard reel strips, as opposed to a dedicated reel, the special symbol 60 acts as a substitute symbol in addition to its special function.

In the embodiment of the invention illustrated in FIGS. 4*a* and 4*b* of the drawings, it is to be noted that two separate special symbols 60 are provided, each being of a different colour. The special symbols 60 are colour coded to correspond with the paytables 56 and 58 associated with each standard symbol 52 in the paytable 50. The special symbol 60 functions as a win change symbol.

Referring now to FIG. 4*a* of the drawings, a win is awarded for 3×K appearing on payline one. Due to the fact that a grey special symbol 60 also appears, the grey paytable 56 is applicable and fifty credits are paid. Had the special symbol 60 not been present, only twenty credits would have been awarded.

In the example shown in FIG. 4*b* of the drawings, the winning result includes two special symbols 60, a grey special symbol and a black special symbol. The player is awarded one hundred credits from the black paytable 58 associated with the standard K symbol 52. Where two or more special symbols 60 are present, only the highest valued win is paid.

Figure 5:
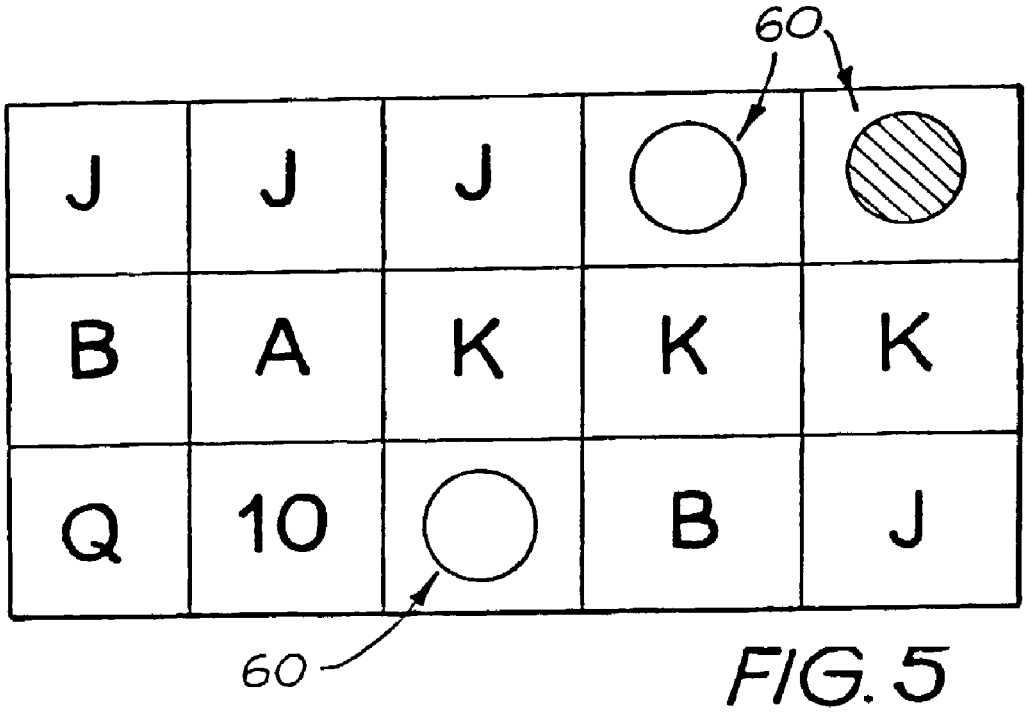
FIG. 5 shows a screen display of a second embodiment of the game.

Referring now to FIG. 5 of the drawings, a different embodiment of the win change special symbol 60 is described. In this case, each special symbol 60 has a specific effect on the way winning combinations will be paid. It is assumed that wins are awarded for combinations occurring on the three standard horizontal paylines.

For example, a standard paytable may be provided where all symbols pay only when appearing in a left-to-right combination on a payline (excluding the scatter feature). In this case, if the grey special symbol 60 appears on the screen, all symbols will pay for a right-to-left combination as well as the left-to-right combination. The black special symbol 60 means that all pays, i.e. the total win, are multiplied by five. The white special symbol 60 substitutes for all standard symbols and any payline win in which such a white symbol 60 substitutes will be multiplied by fifty.

In the embodiment illustrated in FIG. 5 of the drawings, a win will be paid for 3×K because of the appearance of the grey special symbol 60 causing prizes to be paid for right-to left combinations. A further win will be paid for 4×J on payline two due to the white special symbol 60 acting as a substitute symbol. In addition, due to the presence of the white special symbol 60, the win for 4×J on payline two is multiplied by fifty. Finally, due to the presence of the black symbol 60, the total win, ie the sum of all the wins, is multiplied by five.

Figure 6A:
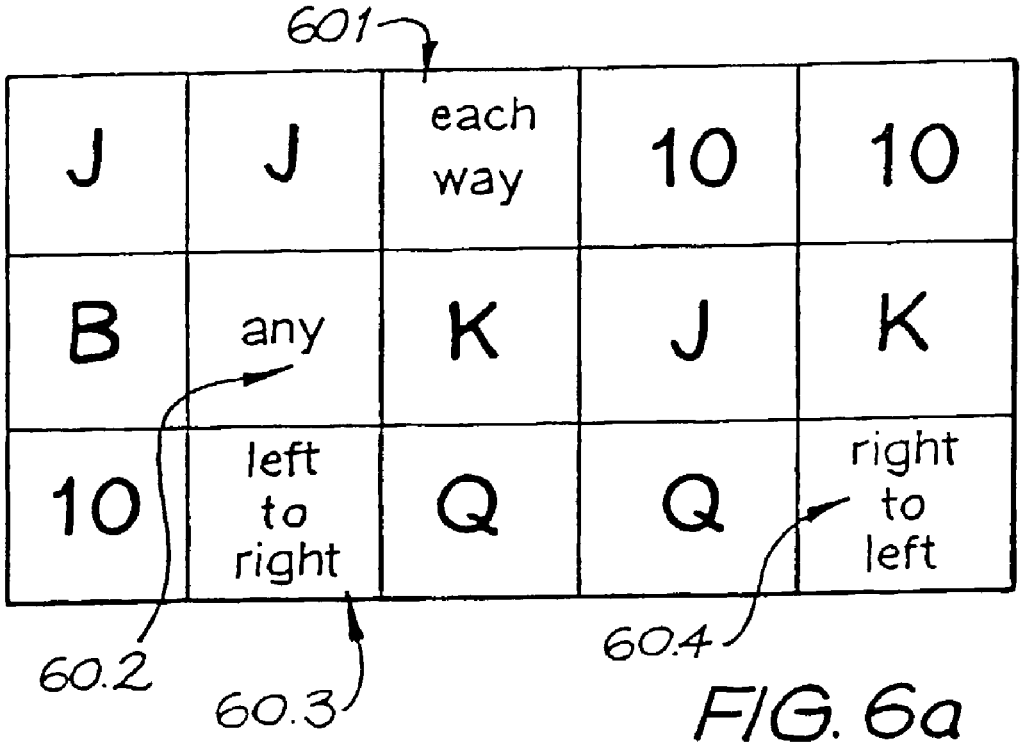
FIGS. 6*a* and 6*b* show screen displays of a third embodiment of the game.
Figure 6B:
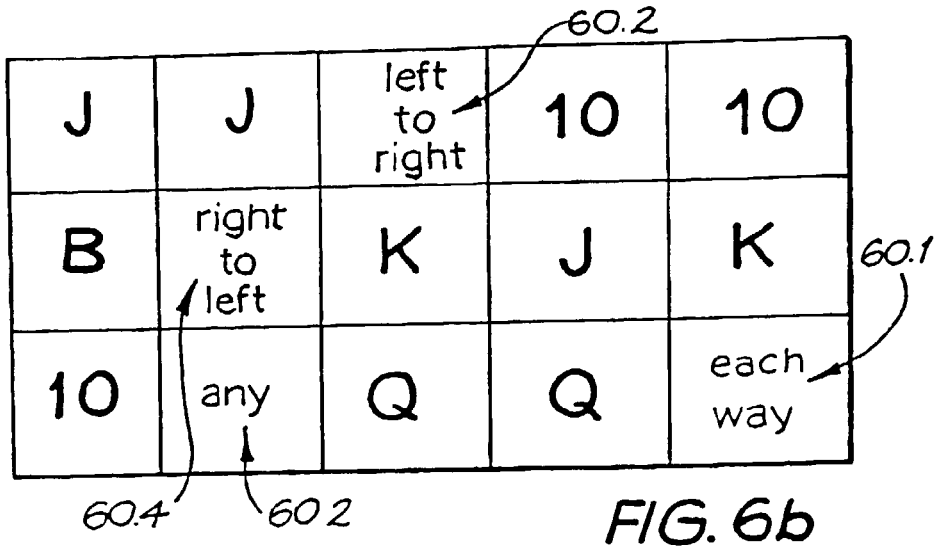
Figure 6C:
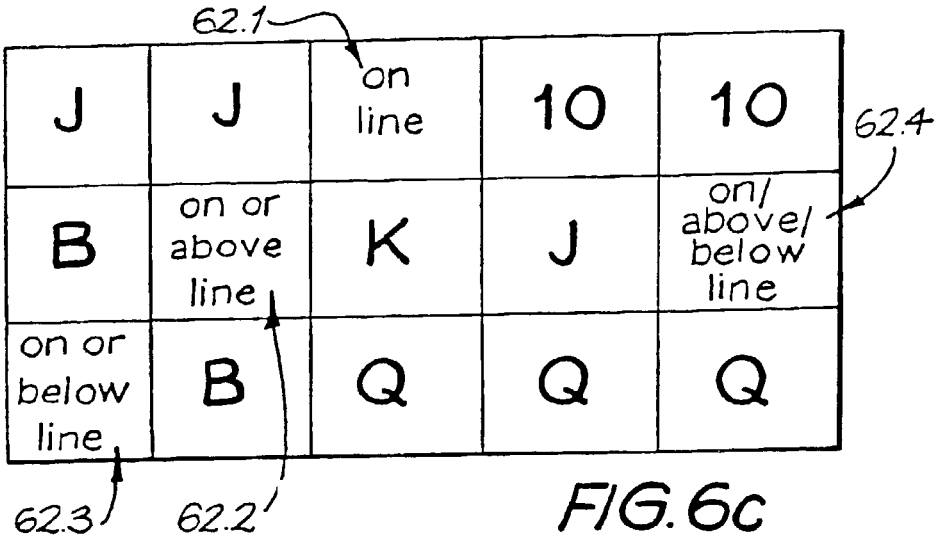
FIG. 6*c* shows a screen display of a fourth embodiment of the game.

Referring now to FIGS. 6*a* to 6*c* of the drawings, yet a further embodiment of the win change special symbol is described. Once again, for all three examples described below, it is assumed that wins are awarded for combinations occurring on the three standard horizontal paylines.

In this embodiment, more than one special symbol 60 could be provided where each has a different function when substituting in a win. The preferred method is where four different special symbols 60.1 to 60.4 are provided. Special symbol 60.1 substitutes as a symbol in a winning combination for a left-to-right or right-to-left win, hereinafter referred to as an each way win, special symbol 60.2 for an "any" win, special symbol 60.3 for a left-to-right win and special symbol 60.4 for a right-to-left win. Thus, for example, the left-to-right special symbol 60.3 will only substitute in left-to-right winning combinations.

Hence, in the example shown in FIG. 6*a* of the drawings wins would be provided for 2×10 because of "left-to-right" symbol 60.3, 3×Q because of "right-to-left" symbol 60.4, 3×J and 3×10 because of "each way" symbol 60.1 and 3×K, 2×B and 2×J because of the "any" symbol 60.2.

If, however, the special symbols appeared in the combination shown in FIG. 6*b* of the drawings, the result would be the following; 3×J with "left-to-right" 60.3 substituting, 3×Q with "each way" symbol 60.1 substituting and 3×Q and 2×10 with the "any" symbol 60.2 substituting.

Instead, the different functions of the special symbols could be where one functions as a standard substitute on a payline as shown by special symbol 62.1 in FIG. 6*c* of the drawings, another functions as a substitute above or on the payline as shown by special symbol 62.2, yet another symbol 62.3 substitutes below or on the payline for combinations on the payline and yet another symbol 62.4 substitutes on, above or below the payline. It is assumed that the standard three horizontal paylines with a left-to-right paying combination applies.

In the example shown in FIG. 6*c* of the drawings, assuming only the highest win pays on any payline, prizes are awarded for 3×J on payline two due to special symbol 62.1, 5×Q on payline three due to special symbol 62.3 and 3×K due to special symbols 62.2 and 62.3.

Figure 6D:
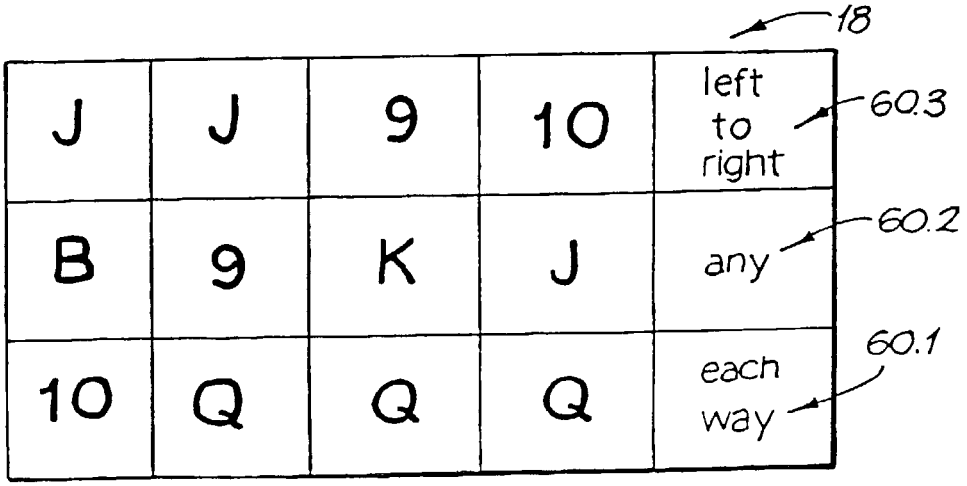
FIG. 6*d* shows a screen display of a fifth embodiment of the game.

In FIG. 6*d* of the drawings, a further version of this embodiment is illustrated. It is assumed in this embodiment that the screen display is for a four reel game. Then, a fifth reel 18 is a dedicated reel carrying the special symbols 60.1 to 60.4 (only symbols 60.1, 60.2 and 60.3 being displayed), the special symbols 60.1 to 60.4 do not serve a substitute function, but only an indicative function. Once again, assuming a three line game, no win is achieved on payline one. If the game pays for two of a kind and because of the presence of the special symbol 60.3, a prize is paid for 2×J on payline two. Due to the presence of the special symbol 60.1, a prize is paid for 3×Q on payline three.

The fifth reel of this version may only spin up or highlight one of the special symbols 60.1 to 60.4 at a time in which case the relevant special symbol will apply to all the active paylines of the game.

Figures 7A, 7B:
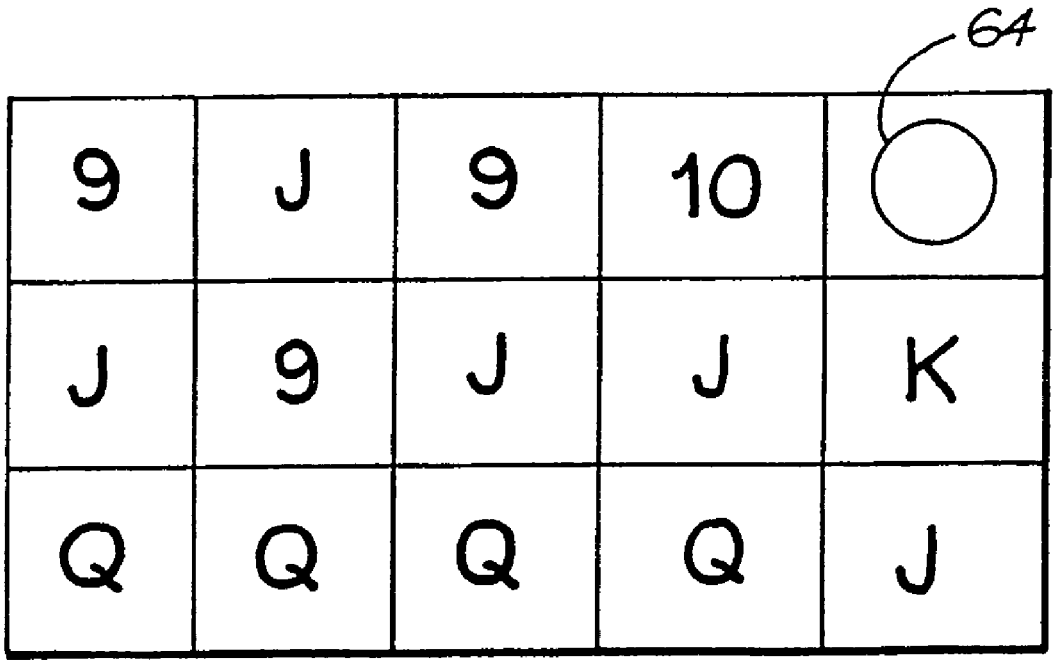
FIGS. 7*a* and 7*b* show screen displays of a sixth embodiment of the game.
Figure 8:
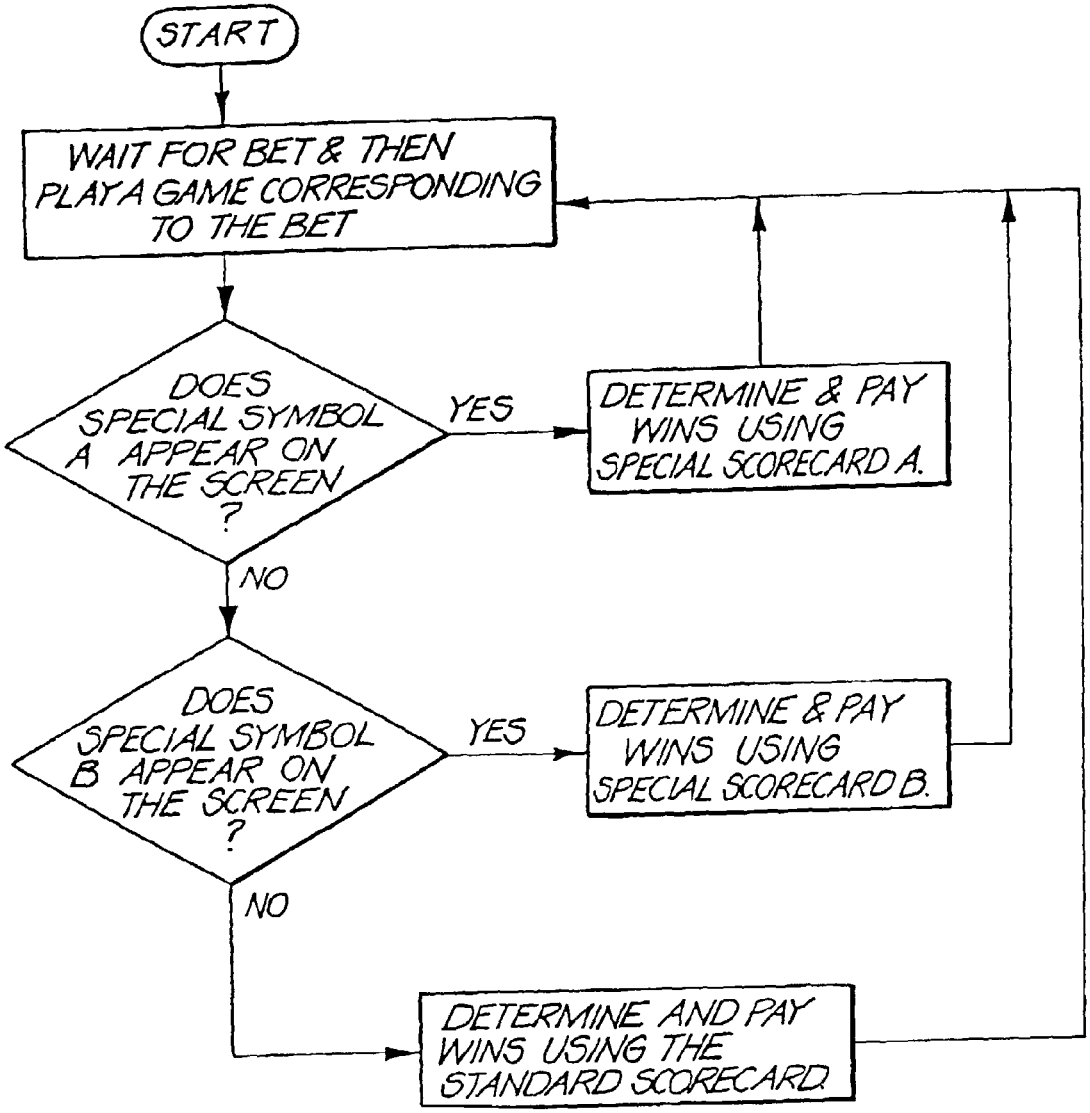
FIG. 8 shows a flow chart of the game described with reference to FIGS. 3 and 4.
Figure 9:
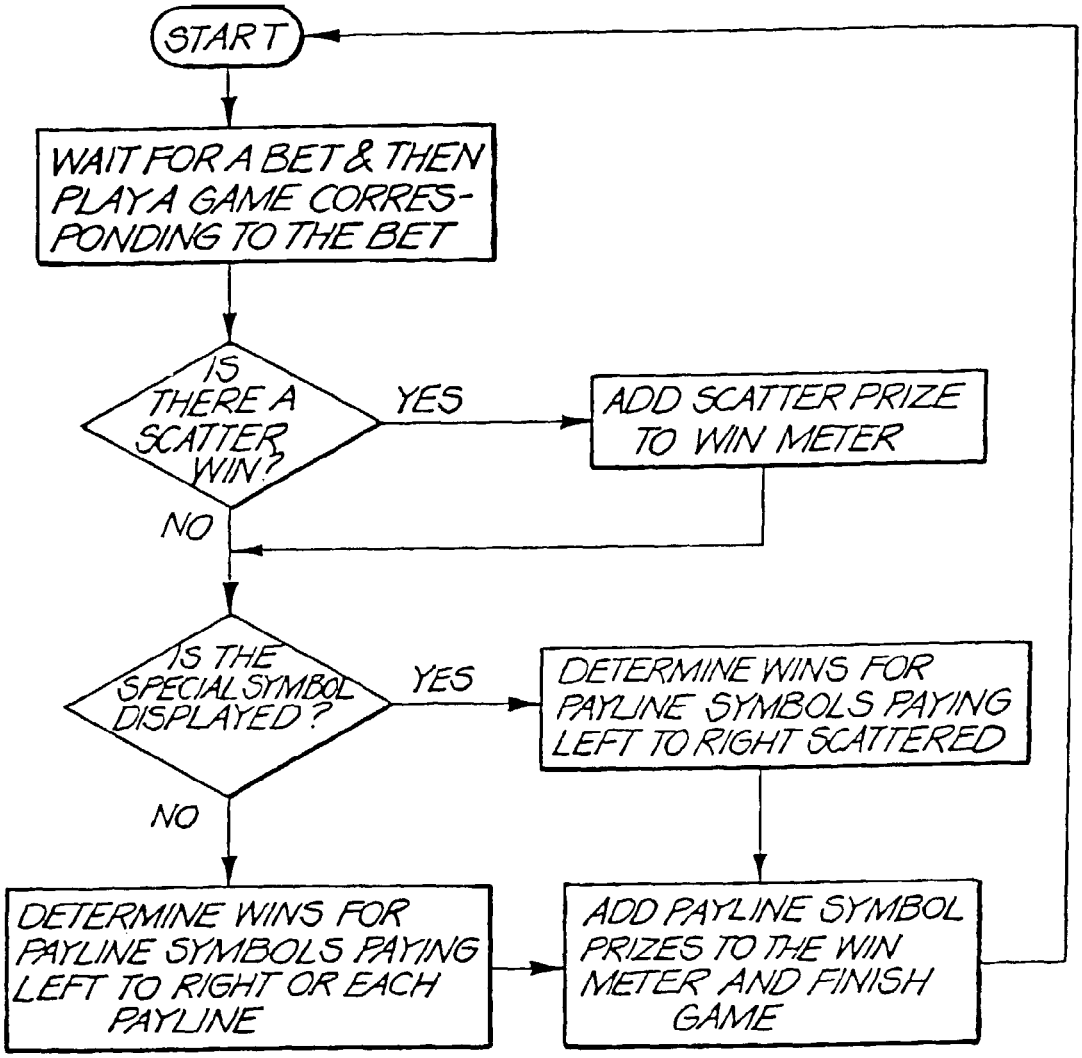
FIG. 9 shows a flow chart of the embodiment of the game of FIG. 7.

Referring to FIGS. 7*a* and 7*b* of the drawings, a further embodiment of the win change special symbol is described. Once again, it is assumed that only the three standard horizontal paylines apply.

In the example illustrated in FIG. 7*a* of the drawings, a prize is awarded only for 4×Q left-to-right on payline 3.

However, when a special symbol 64 is spun up anywhere on the screen, it determines that left-to-right scatter combinations of symbols now pay instead of the symbols having to occur on the paylines. Accordingly, in the example shown in FIG. 7*b* of the drawings, a prize is paid for 5×J, 4×Q and 3×9.

Hence, it is an advantage of the invention that a special symbol is provided which, it is believed, will enhance player interest.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

We claim:

1. A gaming machine having a display and a game controller arranged to control images displayed on the display, the game controller being arranged to play a game in which a player stakes a wager on the outcome of the game and if the outcome is a predefined winning event the gaming machine awards the player a prize, the game being a spinning reel game in which a first set of spinning reels are spun and appear to stop in random positions on the display to thereby define an outcome of a game played on the gaming machine, each spinning reel in the first set of spinning reels having a multiplicity of game outcome symbols carried thereon, said winning events being defined by the position at which each spinning reel in the first set of spinning reels appears to stop, as evidenced by the game outcome symbols carried on each reel in the first set of spinning reels that are displayed in display positions on the display at the outcome of each game, with a plurality of different winning events being defined by different combinations of the game outcome symbols and wherein a first said winning event is defined by a first combination of the game outcome symbols and a second said winning event is defined by a second combination of the game outcome symbols including different ones of the game outcome symbols from the first combination, the value of the prizes associated with different winning events being set out in a paytable applicable to the game being played, wherein the paytable includes for each of the different combinations of the game outcome symbols defining the winning events a plurality of different sub-paytables, the different sub-paytables defining different prizes that may be paid by the gaming machine for combinations of the game outcome symbols, and wherein the gaming machine displays to the player as a part of the paytable each of the plurality of different sub-paytables, in addition to the first set of spinning reels, the game comprises a distinct bonus reel that has at least one special symbol carried thereon, the bonus reel is such that it does not carry any of the game outcome symbols, and wherein each of the special symbols is a symbol that affects which of the sub-paytables is used by the game controller to determine the prize that is paid for a said winning event, the game controller being arranged to spin the bonus reel and to subsequently stop the bonus reel from spinning, which may result in one of the special symbols being displayed in a predefined bonus position on the display, wherein when a said winning event occurs and one of the special symbols is not displayed in the predefined bonus position on the display, the game controller causes the gaming machine to pay a first positive value prize according to a first of the sub-paytables; and when the same said winning event occurs one of the special symbols is displayed in the predefined bonus position on the display, the game controller causes the gaming machine to pay a second positive value prize according to a second of the sub-paytables, wherein the second positive value is greater than the first positive value prize.

2. The gaming machine of claim 1 wherein there are at least three different sub-paytables and a plurality of different special symbols carried on one or more reels, and the different special symbols when appearing on the display at the outcome of a game each result in a different one of the sub-paytables being used to define the prize paid for the particular combination.

3. The gaming machine of claim 1, wherein the different symbol combinations defining the winning events comprise a first symbol combination including a first number of occurrences of a particular symbol and a second symbol combination including a different number of occurrences of the same symbol.

4. The gaming machine of claim 3, wherein there are a plurality of sub-paytables associated with a first symbol, which define prizes for occurrences of combinations of the first symbol and a plurality of sub-paytables associated with a second symbol, which define prizes for occurrences of combinations of the second symbol that are different to the prizes defined for combinations of the first symbol.

5. The gaming machine of claim 1, wherein the sub-paytables define different prizes for a plurality of different symbol combinations, and wherein the plurality of different symbol combinations comprise combinations including different symbols.

* * * * *